US005431120A

United States Patent [19]

Ancarola

[11] Patent Number: 5,431,120

[45] Date of Patent: Jul. 11, 1995

[54] SAILING VESSEL

[76] Inventor: Carlos M. Ancarola, Manzanares 1752, (1429) Buenos Aires, Argentina

[21] Appl. No.: 218,639

[22] Filed: Mar. 28, 1994

[51] Int. Cl.[6] ..... B63H 9/04

[52] U.S. Cl. ..... 114/71

[58] Field of Search ..... 114/39.1, 65 R, 71

[56] References Cited

U.S. PATENT DOCUMENTS

| | | | |
|---|---|---|---|
| 4,664,050 | 5/1987 | Clauser | 114/39.1 |
| 4,934,295 | 6/1990 | Atkinson et al. | 114/39.1 |
| 5,231,943 | 8/1993 | Benze | 114/39.1 |

*Primary Examiner*—Stephen P. Avila
*Attorney, Agent, or Firm*—Finnegan, Henderson, Farabow, Garrett & Dunner

[57] ABSTRACT

In a sailing vessel having a gunwale, a cockpit located in a rear portion of the vessel having a floor below the level of the gunwale and a companionway hood adjacent a front end of the cockpit having a height at least as high as the level of the gunwale, the improvement wherein the cockpit has three longitudinally extending sections, the central section having a height at its front end adjacent the companionway hood similar to that of said hood, the height decreasing toward the rear of the vessel, while the two side sections on either side of the central section of the cockpit have a floor which is approximately horizontal and below the level of the gunwale. Openings are provided in the front part of each of the side sections of the cockpit permitting access to the interior of the vessel.

4 Claims, 3 Drawing Sheets

SAILING VESSEL

BACKGROUND OF THE INVENTION

The present invention relates to a sailing vessel, which may have auxiliary engine, and, more particularly, to a novel deck structure for the sailing vessel or craft which makes it possible to obtain a larger interior cabin space.

Sailing craft usually have an open cockpit which, at its front end, has an access way to the interior of the central part of the craft. Some designs have two accesses or hatchways which connect the cockpit to the inside of the craft, one on each side of the craft.

However, because the cockpit usually has a floor of uniform height lower than the remaining deck of the vessel, the inner height of the interior part of the vessel in the area under the cockpit may not be high enough to enable a person to stand upright. This is particularly the case in craft of up to 12 meters in length, while, in larger craft, the height may be sufficient.

SUMMARY OF THE INVENTION

The present invention solves these problems and makes it possible to provide an interior cabin in the aft area of the craft, under the cockpit, with a height which makes it possible for a person to comfortably remain standing and/or seated inside the same.

To this end, the invention provides for the central part of the companionway hood of the craft to be extended aft, occupying a central longitudinal part of the cockpit, the lateral longitudinal parts on either side thereof constituting two passageways or lateral cockpits which, at their front part, are provided with openings on the stern facing bulkhead of the companionway hood for access to the interior of the craft.

BRIEF DESCRIPTION OF THE DRAWINGS

An example of the invention is illustrated in the accompanying drawings, in which.

DETAILED DESCRIPTION OF THE INVENTION

Figure 1:
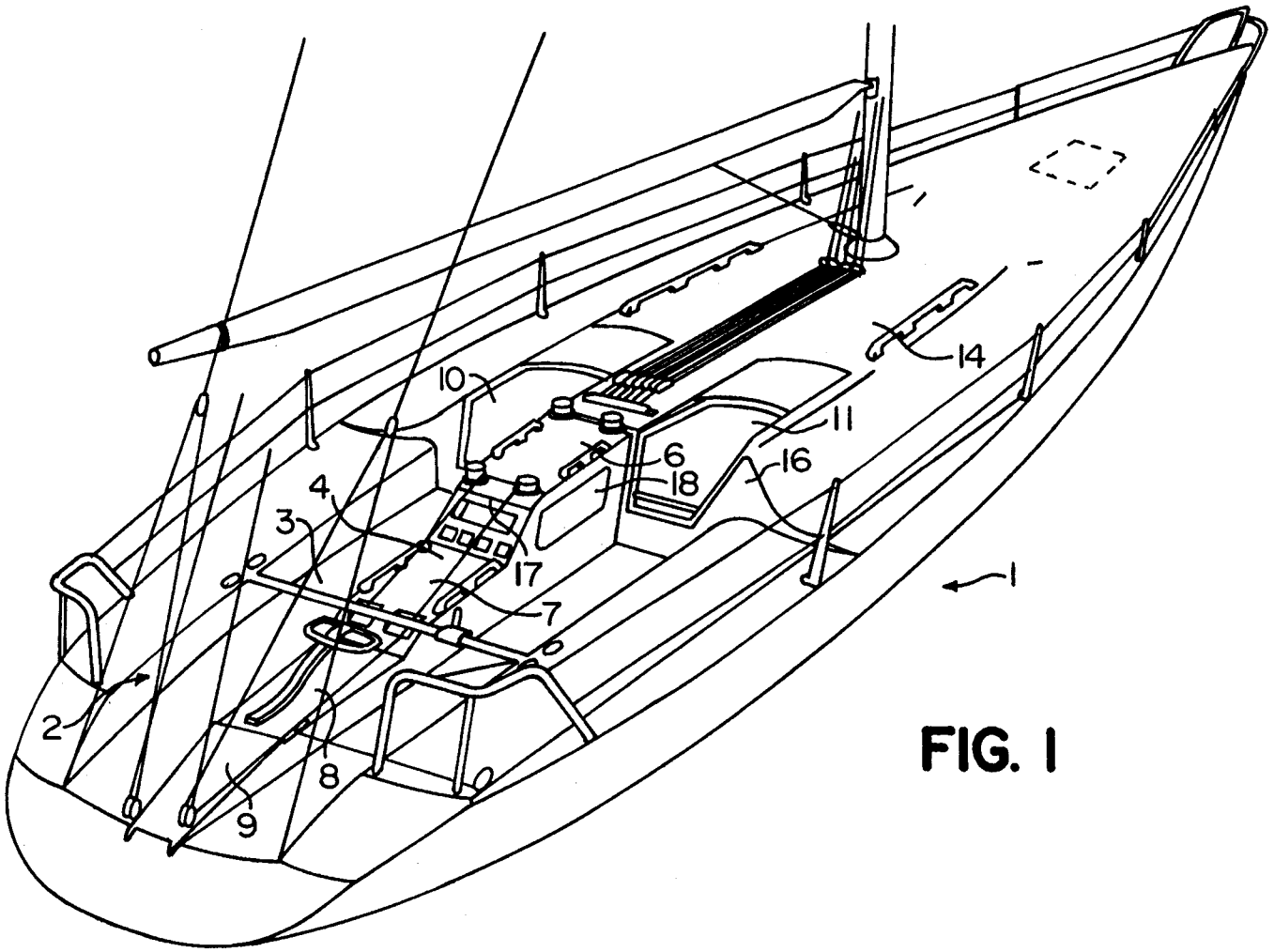
FIG. 1 is a perspective view of a sailing craft having a cockpit constructed according to the present invention.

In the drawings, a sailing vessel 1 has a cockpit 2 that is divided into three longitudinal sections 3, 4 and 5. The sections 3 and 5 have, at their front end, openings or hatchways 10 and 11, respectively, which permit access to the interior or inside 12 of the vessel via two stairways 13, one on each side of the vessel (FIG. 3).

A companionway hood 14 has, in the middle or central part of the vessel, an extended central portion 6 extending longitudinally toward the rear or stern of the vessel in the middle section 4 of the cockpit 2. As best shown in FIG. 3, because its height is the same as the hood 14, a person can easily stand in the area of the stern cabin 15 immediately beneath this extended portion 6, access to it being gained by a door (not shown) in the bulkhead 16 between cabin 15 and interior space 12 of the vessel.

Figure 2:
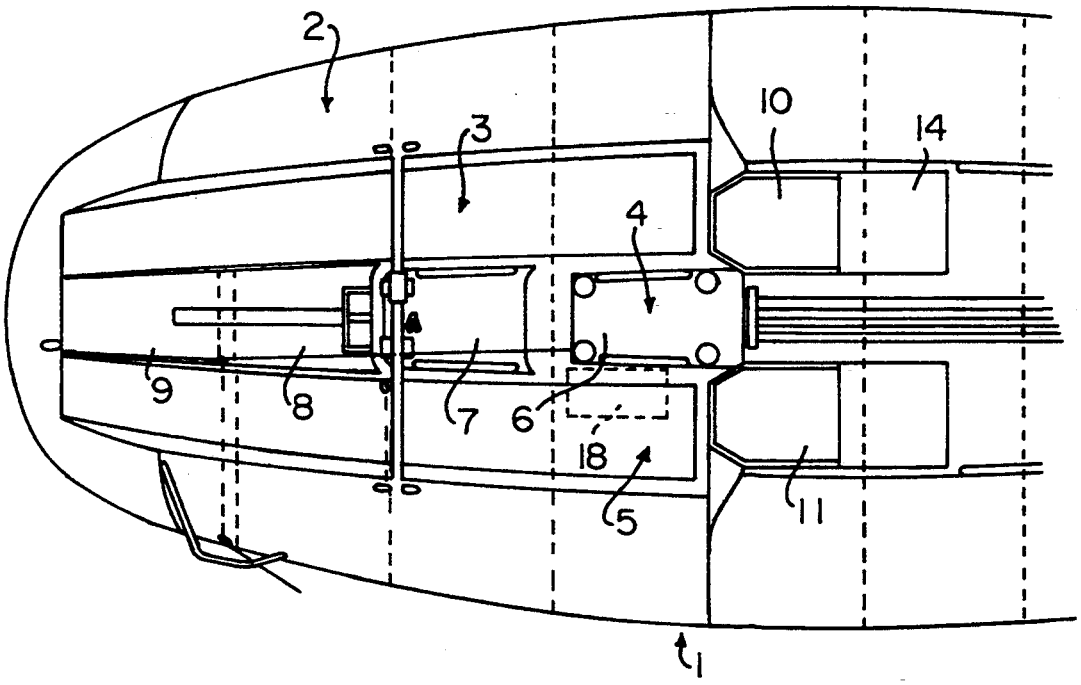
FIG. 2 is a partial top plan view of the cockpit area of the craft.
Figure 3:
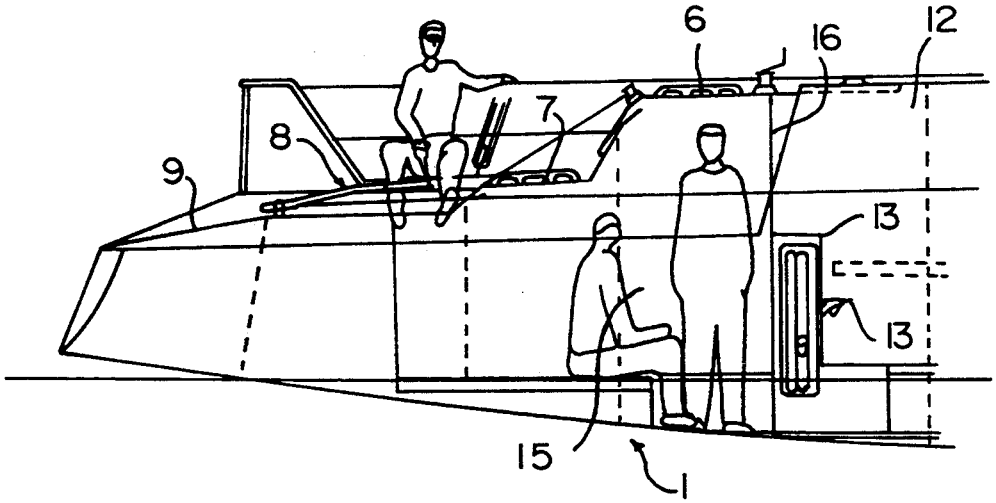
FIG. 3 is a partial view in vertical longitudinal central cross section of the craft according to the invention.
Figure 4:
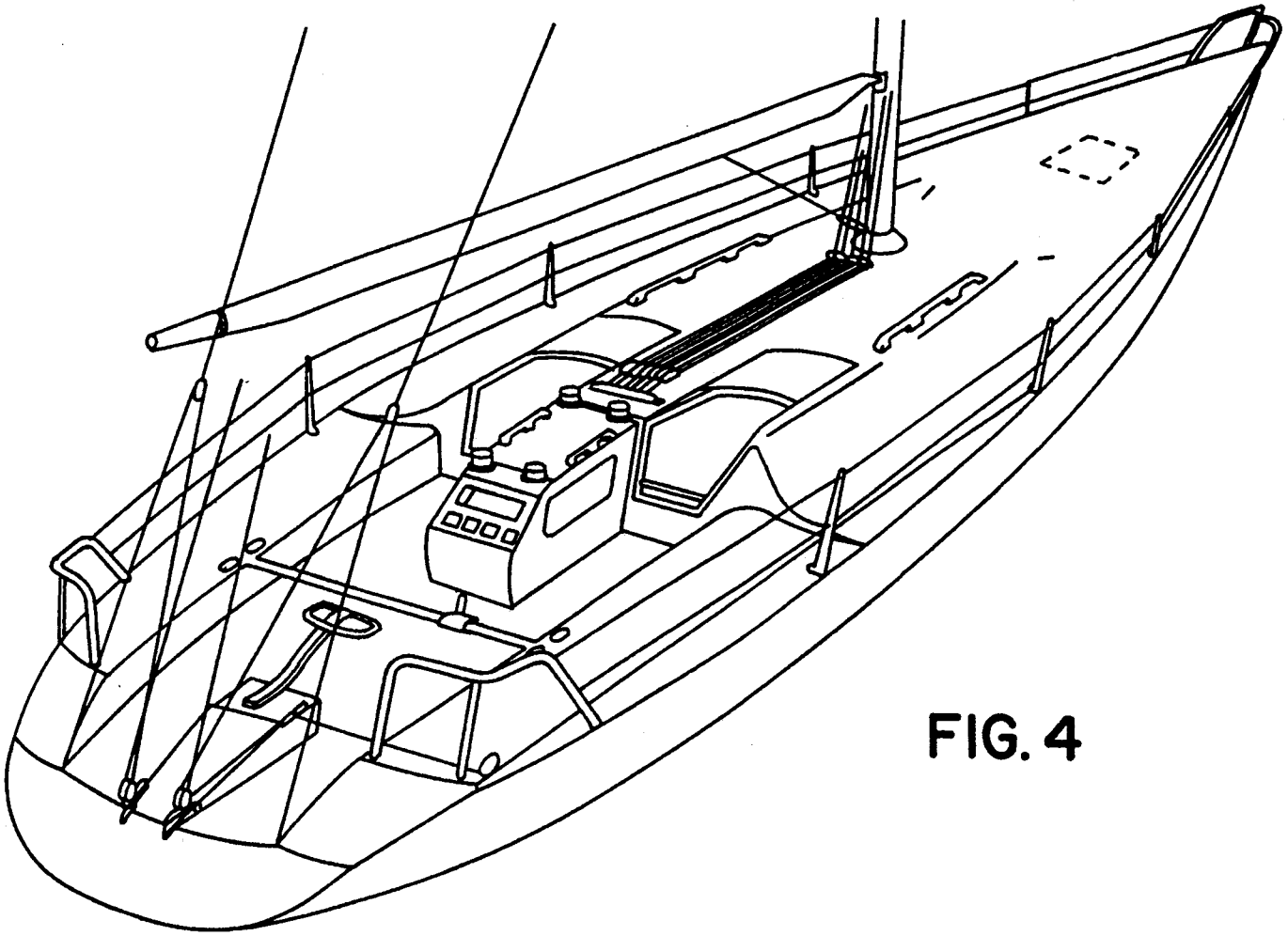
FIG. 4 is a perspective view of an alternative embodiment of the invention.

This extended portion 6 of the companionway hood may be extended rearwardly of the vessel only a given distance from the companionway hood 14 as shown in FIG. 4 or, as shown in FIGS. 1 to 3, may be continued with decreasing heights 7, 8 and 9. Obviously, it is unnecessary for this extended portion 6 to have a height identical to that of the companionway hood 14, it being possible, if this is permitted by the required interior height, to have a height lower than the companionway hood.

With reference to FIG. 1, in the descending end part 17 of the extended central portion 6, it is possible to locate navigation instruments and a window affording light and ventilation to the stern cabin 15. Moreover, on the upper part it is possible to locate windlasses for maneuvering the running rigging and, on the sides, small fold-down tables 18.

It is also possible to provide, in said extended central portion 6 or in its extension 7 and 8 of lesser height, other elements such as handrails, stoppers, cleats, etc., for handling the halyards and other elements of the vessel which come rearwardly from the foot of the mast.

Further, a cover may be provided on the portion 6 that covers all the ropes running along it.

What is claimed is:

1. In a sailing vessel having a gunwale, a cockpit located in a rear portion of the vessel having a floor below the level of the gunwale and a companionway hood adjacent a front end of the cockpit having a height at least as high as the level of the gunwale, the improvement wherein said cockpit comprises three sections extending longitudinally of the vessel, a central section having a height at its front end adjacent the companionway hood similar to that of said hood, said height of the central section decreasing toward the rear of the vessel, and two side sections on either side of said central section of the cockpit having a floor which is approximately horizontal and below the level of the gunwale and openings in the front part of each of said side sections of the cockpit permitting access to the interior of the vessel.

2. The sailing vessel of claim 1, wherein said central section has a height similar to that of the companionway hood in a front portion thereof with the rear portion thereof being level with the floor of the two side sections of the cockpit.

3. The sailing vessel of claim 1, wherein said central section has a front portion of height similar to that of the companionway hood which then decreases in a slanting manner towards the rear of the vessel.

4. In a sailing vessel having a gunwale, a cockpit located in a rear portion of the vessel having a floor below the level of the gunwale and a companionway hood adjacent a front end of the cockpit having a height at least as high as the level of the gunwale, the improvement wherein said cockpit comprises three sections extending longitudinally of the vessel, a central section having a height at its front end adjacent the companionway hood similar to that of said hood, said height of the central section decreasing in a staggered manner toward the rear of the vessel, and two side sections on either side of said central section of the cockpit having a floor which is approximately horizontal and below the level of the gunwale and openings in the front part of each of said side sections of the cockpit permitting access to the interior of the vessel.

* * * * *